US009180684B2

(12) United States Patent
Washington et al.

(10) Patent No.: US 9,180,684 B2
(45) Date of Patent: Nov. 10, 2015

(54) AUTOFOCUS LED PRINT HEAD MECHANISM

(71) Applicant: Xerox Corporation, Norwalk, CT (US)

(72) Inventors: John R. Washington, Hitchin (GB); Charlotte E. Przeslak, Welwyn Garden City (GB)

(73) Assignee: Xerox Corporation, Norwalk, CT (US)

( * ) Notice: Subject to any disclaimer, the term of this patent is extended or adjusted under 35 U.S.C. 154(b) by 15 days.

(21) Appl. No.: 14/132,431

(22) Filed: Dec. 18, 2013

(65) Prior Publication Data

US 2015/0165785 A1 Jun. 18, 2015

(51) Int. Cl.

| | |
|---|---|
| ***B41J 2/385*** | (2006.01) |
| ***G03G 13/04*** | (2006.01) |
| ***B41J 2/415*** | (2006.01) |
| ***G03G 9/08*** | (2006.01) |
| ***B41J 2/155*** | (2006.01) |
| ***B41J 29/38*** | (2006.01) |
| ***B41J 29/393*** | (2006.01) |
| ***B41J 2/45*** | (2006.01) |
| ***G03G 15/043*** | (2006.01) |
| ***G03G 15/00*** | (2006.01) |

(52) U.S. Cl.

CPC ..... *B41J 2/451* (2013.01); *G03G 15/043* (2013.01); *G03G 15/5041* (2013.01)

(58) Field of Classification Search

CPC ..... H04N 1/1135; B41J 2/471; B41J 2/4476; B41J 2/45; B41J 2/451; B41J 2/155; B41J 29/393; G03G 15/328; G03G 15/325; G03G 15/348; G03G 15/04054; G03G 15/04072; G03G 2215/0404; G03G 2215/0407; G03G 2215/0409; G03G 15/326; G03G 15/305; G03G 15/043

USPC ..... 347/134, 122, 154, 42, 13, 19

See application file for complete search history.

(56) References Cited

U.S. PATENT DOCUMENTS

| | | | | | |
|---|---|---|---|---|---|
| 4,879,000 | A | * | 11/1989 | Gausa | 162/198 |
| 4,893,010 | A | * | 1/1990 | Tomatsu | 250/318 |
| 4,942,405 | A | * | 7/1990 | Dody et al. | 347/238 |
| 5,091,682 | A | * | 2/1992 | Naganuma et al. | 318/560 |
| 5,212,417 | A | * | 5/1993 | Nagai et al. | 310/49.15 |
| 5,309,197 | A | * | 5/1994 | Mori et al. | 355/53 |
| 5,383,014 | A | * | 1/1995 | Nowak et al. | 356/28 |
| 5,521,036 | A | * | 5/1996 | Iwamoto et al. | 430/22 |
| 5,574,485 | A | * | 11/1996 | Anderson et al. | 347/27 |
| 5,774,153 | A | * | 6/1998 | Kuehnle et al. | 347/129 |
| 5,793,390 | A | * | 8/1998 | Claflin et al. | 347/33 |
| 6,089,696 | A | * | 7/2000 | Lubinsky | 347/40 |

(Continued)

FOREIGN PATENT DOCUMENTS

| | | | |
|---|---|---|---|
| DE | 4023411 | A1 * | 2/1992 |
| EP | 1018570 | A1 * | 7/2000 |

(Continued)

*Primary Examiner* — Julian Huffman
*Assistant Examiner* — Leonard S Liang
(74) *Attorney, Agent, or Firm* — Fay Sharpe LLP

(57) ABSTRACT

A method is provided for automatically positioning a print head (12) relative to a photoreceptor (14) in a xerographic print engine (10). The method includes: operating the print head (12) to produce an indicia in a latent image formed on the photoreceptor (14); measuring a dimension of the indicia; and automatically positioning the print head (12) relative to the photoreceptor (14) in response to a result of the measuring.

15 Claims, 1 Drawing Sheet

(56) References Cited

U.S. PATENT DOCUMENTS

| | | | | |
|---|---|---|---|---|
| 6,155,669 | A * | 12/2000 | Donahue et al. | 347/42 |
| 6,365,307 | B1 * | 4/2002 | Markovics | 430/30 |
| 6,454,382 | B1 * | 9/2002 | Galentovski | 347/19 |
| 6,493,010 | B1 * | 12/2002 | Takahashi et al. | 347/116 |
| 6,578,945 | B2 * | 6/2003 | Hashi et al. | 347/22 |
| 6,609,845 | B1 * | 8/2003 | Ninomiya | 400/124.08 |
| 6,747,684 | B2 * | 6/2004 | Ornellas et al. | 347/243 |
| 7,014,289 | B1 * | 3/2006 | Matsuda | 347/19 |
| 7,589,751 | B2 * | 9/2009 | Fukutome et al. | 347/138 |
| 8,235,609 | B2 * | 8/2012 | Chuang | 400/58 |
| 8,654,171 | B2 * | 2/2014 | Minabe et al. | 347/256 |
| 2006/0146120 | A1 * | 7/2006 | Joichi et al. | 347/238 |
| 2008/0106747 | A1 * | 5/2008 | Kudo et al. | 356/616 |
| 2008/0252713 | A1 * | 10/2008 | Horikawa | 347/237 |
| 2008/0299473 | A1 * | 12/2008 | Inagaki et al. | 430/58.05 |
| 2009/0060542 | A1 * | 3/2009 | Kawada et al. | 399/47 |
| 2009/0060544 | A1 * | 3/2009 | Kawada et al. | 399/51 |
| 2009/0074438 | A1 * | 3/2009 | Kawada et al. | 399/51 |
| 2012/0163844 | A1 * | 6/2012 | Murayama et al. | 399/49 |
| 2013/0249979 | A1 * | 9/2013 | Wing et al. | 347/8 |
| 2014/0314433 | A1 * | 10/2014 | Yamashita et al. | 399/49 |

FOREIGN PATENT DOCUMENTS

| | | | |
|---|---|---|---|
| JP | 2001125347 | A * | 5/2001 |
| JP | 2003175636 | A * | 6/2003 |
| JP | 2005107367 | A * | 4/2005 |
| JP | 2008015165 | A * | 1/2008 |

* cited by examiner

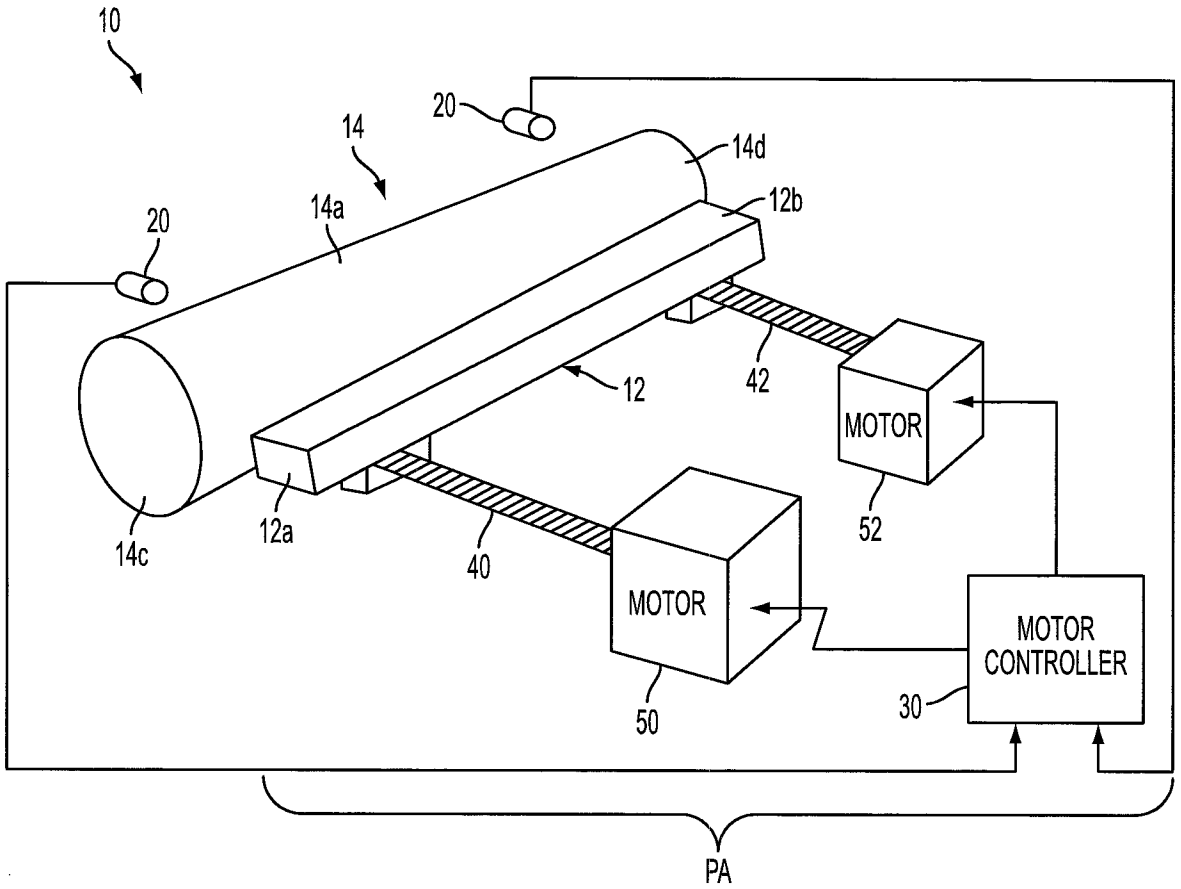
MOTOR CONTROLLER
30
MOTOR
52
MOTOR
50
PA
42
40
12
12a
12b
14
14a
14c
14d
20
20
10

AUTOFOCUS LED PRINT HEAD MECHANISM

BACKGROUND

The present inventive subject matter relates generally to the art of xerography. Particular but not exclusive relevance is found in connection with xerographic print engines, e.g., such as found in printers, copiers, facsimile machines, multi-function printers, etc. The present specification accordingly makes specific reference thereto at times. However, it is to be appreciated that aspects of the present inventive subject matter are also equally amenable to other like applications and/or environments.

A xerographic print engine generally includes a photoreceptor or photosensor, e.g., in the form of a rotating cylindrical drum or belt or otherwise. In some xerographic print engines, a row or bar of light emitting diodes (LEDs), also known as an LED print head, is used to selectively illuminate a surface of the photoreceptor with light to produce and/or define a latent image thereon. The latent image may then be transferred from the photoreceptor to a sheet of paper or other image receiving medium, e.g., using toner or another suitable marking agent developed on a surface of the photoreceptor in accordance with the latent image.

Inaccurate positioning of the LED print head with respect to the surface of the photoreceptor can adversely impact how light from the LED print head is focused on the surface of the photoreceptor. In turn, an out of focus or poorly focused LED print head can adversely impact printing, e.g., it can introduce unwanted image artifacts.

One conventional approach to address accurate positioning of the LED print head with respect to the surface of the photoreceptor is to employ mechanical distance setting mechanisms, e.g., such a pins datuming and/or setting a spacing of the LED print head relative to the surface of the photoreceptor. However, in a dynamic xerographic print engine, such a solution may be insufficiently accurate and/or consistent or otherwise generally inadequate for some applications. For example, in some applications, it may be desired that a focused spot of light from an LED of the print head remains less than about 50 μm across on the surface of the photoreceptor, and generally it may be difficult and/or impractical to accurately and/or consistently achieve this degree of focus using such a pin datuming approach, e.g., due to variations in mechanical tolerances.

Accordingly, a new and/or improved method, system and/or apparatus is disclosed for automatically positioning and/or focusing a print head which addresses the above-referenced problem(s) and/or others.

SUMMARY

This summary is provided to introduce concepts related to the present inventive subject matter. The summary is not intended to identify essential features of the claimed subject matter nor is it intended for use in determining or limiting the scope of the claimed subject matter. The embodiments described below are not intended to be exhaustive or to limit the invention to the precise forms disclosed in the following detailed description. Rather, the embodiments are chosen and described so that others skilled in the art may appreciate and understand the principles and practices of the present inventive subject matter.

In accordance with one embodiment, a method is provided for automatically positioning a print head relative to a photoreceptor in a xerographic print engine. The method includes: operating the print head to produce an indicia in a latent image formed on the photoreceptor; measuring a dimension of the indicia; and automatically positioning the print head relative to the photoreceptor in response to a result of the measuring.

In accordance with another embodiment, a xerographic print engine includes: a photoreceptor; a print head arranged to selectively illuminate the photoreceptor in order to form a latent image on the photoreceptor, the latent image including an indicia; a detector which is employed to measure a dimension of the indicia; and a positioning assembly that receives feedback from said detector and in response to the measured dimension of the indicia automatically adjusts a spacing between the print head and the photoreceptor.

Numerous advantages and benefits of the inventive subject matter disclosed herein will become apparent to those of ordinary skill in the art upon reading and understanding the present specification. It is to be understood, however, that the detailed description of the various embodiments and specific examples, while indicating preferred and/or other embodiments, are given by way of illustration and not limitation. Many changes and modifications within the scope of the present invention may be made without departing from the spirit thereof, and the invention includes all such modifications.

BRIEF DESCRIPTION OF THE DRAWING(S)

The following detailed description makes reference to the figures in the accompanying drawings. However, the inventive subject matter disclosed herein may take form in various components and arrangements of components, and in various steps and arrangements of steps. The drawings are only for purposes of illustrating exemplary and/or preferred embodiments and are not to be construed as limiting. Further, it is to be appreciated that the drawings may not be to scale.

The sole FIGURE is a diagrammatic illustration showing selected elements of an exemplary xerographic print engine incorporating one or more aspects of the present inventive subject matter.

DETAILED DESCRIPTION OF THE EMBODIMENT(S)

For clarity and simplicity, the present specification shall refer to structural and/or functional elements, relevant standards, algorithms and/or protocols, and other components, algorithms, methods and/or processes that are commonly known in the art without further detailed explanation as to their configuration or operation except to the extent they have been modified or altered in accordance with and/or to accommodate the preferred and/or other embodiment(s) presented herein. Moreover, the apparatuses and methods disclosed in the present specification are described in detail by way of examples and with reference to the figures. Unless otherwise specified, like numbers in the figures indicate references to the same, similar or corresponding elements throughout the figures. It will be appreciated that modifications to disclosed and described examples, arrangements, configurations, components, elements, apparatuses, methods, materials, etc. can be made and may be desired for a specific application. In this disclosure, any identification of specific materials, techniques, arrangements, etc. are either related to a specific example presented or are merely a general description of such a material, technique, arrangement, etc. Identifications of specific details or examples are not intended to be, and should not be, construed as mandatory or limiting unless specifically designated as such. Selected examples of apparatuses and methods are hereinafter disclosed and described in detail with reference made to the figures.

In general, there is disclosed herein a method and/or system which is operative to autofocus a print head and/or automatically position a print head relative to a surface of a photoreceptor in a xerographic print engine.

With reference now to the sole FIGURE, a xerographic print engine 10 includes an elongated print head 12 and a photoreceptor 14. As shown, the photoreceptor 14 generally takes the form of a rotatable cylindrical drum. However, in practice, the photoreceptor may take the form of a belt or some other suitable form that is selectively advanced relatively past the print head 12.

As shown, the print head 12 is arranged to extend generally along a length of the photoreceptor 14 and to selectively illuminate a surface 14*a* of the photoreceptor 14 to define, form and/or produce a latent image thereon, e.g., as the photoreceptor 14 rotates or otherwise advances past the print head 12. Suitably, the print head 12 is an LED print head, e.g., including a row or array of discreet individual LEDs along its length which are controlled to selectively illuminate the surface 14*a* of the photoreceptor 14. However, in practice, other suitable print heads may be employed, e.g., having a row or array of other discreet light emitting and/or transmitting elements or some other construction where it is desirable to have an accurate and/or consistent focus of light from the print head and/or print head elements on the surface of the photoreceptor.

A positioning assembly PA operates, based on feedback and/or signals from one or more detectors 20, to automatically position the print head 12 relative to the surface 14*a* of the photoreceptor 14 so as to achieve a desired focus, e.g., of light emitted from the LEDs of the print head 12 on the surface 14*a* of the photoreceptor 14. Suitably, as shown, the positioning assembly PA may independently space opposite ends 12*a* and 12*b* of the print head 12 set distances from the surface 14*a* of the photoreceptor 14. More specifically, the illustrated positioning assembly PA includes: a motor controller 30 operative to receive measurements and/or signals from the detector(s) 20 and based thereon control operation of selected motors; a first lead screw 40 operatively engaged with the first end 12*a* of the print head 12; a second lead screw 42 operatively engaged with the second end 12*b* of the print head 12; a first motor 50 operatively engaged with the first lead screw 40 in order to selectively turn the first lead screw 40 in response to commands and/or signals received from the motor controller 30; and a second motor 52 operatively engaged with the second lead screw 42 in order to selectively turn the second lead screw 42 in response to commands and/or signals received from the motor controller 30. Selectively turning the first lead screw 40 in a first direction selectively advances the first end 12*a* of the print head 12 toward the surface 14*a* of the photoreceptor 14, and conversely, selectively turning the first lead screw 40 in a second direction (i.e., opposite the first) selectively retracts the first end 12*a* of the print head 12 away from the surface 14*a* of the photoreceptor 14. Similarly, selectively turning the second lead screw 42 in a first direction selectively advances the second end 12*b* of the print head 12 toward the surface 14*a* of the photoreceptor 14, and conversely, selectively turning the second lead screw 42 in a second direction (i.e., opposite the first) selectively retracts the second end 12*b* of the print head 12 away from the surface 14*a* of the photoreceptor 14.

Suitably, in practice, the motors 50 and 52 and lead screws 40 and 42 are arranged to allow for very fine movement and/or positioning of the respective ends 12*a* and 12*b* of the print head 12. In one suitable embodiment, the motors 50 and 52 may be stepper motors and the motors 50 and 52 and screws 40 and 42 are arranged to move their respective ends 12*a* and 12*b* of the print head 12 about 1.75 μm per motor step. For example, to achieve such fine movement, the motors 50 and 52 may turn and/or turn the screws 40 and 42 by about 1.8 degrees per motor step, and the screws 40 and 42 may be, e.g., M3 fine (as defined by the International Organization for Standardization (ISO) 261 standard). That is to say, the screws 40 and 42 may have about a 3 mm nominal major diameter and a thread pitch of about 0.35 mm. Suitably, the length of the screws 40 and 42 accommodate a range of motion for each end 12*a* and 12*b* of the print head 12 to travel approximately +/−50 μm from a nominal central position.

In one exemplary embodiment, the detector(s) 20 may be high precision optical sensors and/or other suitable sensors that are positioned and/or operable to detect registration marks, lines, bands and/or other indicia formed on the surface 14*a* of the photoreceptor 14. In one embodiment, the detector(s) 20 may include optical sensors which detect and/or measure developed marks and/or other indicia formed on the surface 14*a* of the photoreceptor 14, e.g., with toner or another suitable marking agent. That is to say, the detector(s) 20 optically detect visible marks, lines and/or other indicia that are formed on the surface 14*a* of the photoreceptor 14 with toner or another suitable marking agent according to a latent image produced on the photoreceptor 14 via the print head 12. Alternately, the detector(s) 20 may detect directly indicia in the latent image produced on the photoreceptor 14 by the print head 12.

In one exemplary embodiment, the xerographic print engine 10 is a color print engine which is provisioned with a pair of high precision optical sensors, e.g., mounted a fixed distance apart. These sensors, e.g., measure bands imaged onto a photoreceptor. Suitably, these sensors are otherwise used to measure, e.g., with micron precision, the color-to-color registration of each of the various color separations employed in the color print engine, to adjust the timing of the color separations, and they may also be used to measure the density of patches to allow a highly consistent color reproduction from sheet to sheet and/or from day to day. Such sensors are sometimes referred to as mark-on-belt (MOB) sensors. Suitably, these same sensors (or sensors such as these) may also be employed as the detector(s) 20 utilized herein, e.g., in addition to performing their other functions.

In any event, the detector(s) 20 detect and/or measure marks and/or indicia formed on the photoreceptor 14 according to a latent image produced on the photoreceptor 14 by the print head 12, and provide feedback and/or signals indicative thereof to the motor controller 30. For example, the detector(s) 20 may detect and/or measure a width or other suitable dimension or parameter of such marks or indicia. In turn, based on and/or responsive to the signals and/or feedback received from the detector(s) 20, the motor controller 30 signals and/or commands the respective motors 50 and 52 to selectively turn the screws 40 and 42 in one direction and/or the other, thereby selectively moving the respective ends 12*a* and 12*b* of the print head 12 toward and/or away from the surface 14*a* of the photoreceptor 14 so as to automatically position the print head 12 relative to the surface 14*a* of the photoreceptor 14 to achieve a desired focus of light (e.g., emitted from LEDs of the print head 12) on the surface 14*a* of the photoreceptor 14.

In one suitable embodiment, the mark or indicia produced by the print head 12 and/or carried on the photoreceptor 14 which is measured by the detector(s) 20 takes the form of a line. Suitably, a desired focus is achieved when a width of the line as measured by the detector(s) 20 is at a minimum (i.e., a desired focus is achieved when the line is narrowest or thinnest). Accordingly, in one exemplary embodiment, one or more lines are imaged on the photoreceptor 14 with the print head 12, while simultaneously or otherwise a width of those lines being imaged are measured (e.g., using the detector(s) 20). Based on intermittent, periodic and/or otherwise ongoing measurements of the width of the lines, the positioning assembly automatically adjusts the position of the print head 12 relative to the surface 14*a* of the photoreceptor 14 (e.g., by selectively moving ends 12*a* and/or 12*b* of the print head 12 towards and/or away from the surface 14*a* of the photoreceptor 14), thereby causing the width of the lines being image thereon to vary as the light (e.g., emitted from LEDs of the print head 12) goes into and/or out of focus on the surface 14*a* of the photoreceptor 14. Suitably, the foregoing process continues and/or repeats until the measured width of the lines reaches a minimum. For example, a desired focus (i.e., minimum line width) may be achieved when the print head 12 is about 2.5 mm from the surface 14*a* of the photoreceptor 14. Of course, this may depend on a focal length of the light emitting and/or light transmitting elements of the print head 12. Suitably, the minimum line width is less than approximately 50 microns (aka micrometers).

Optionally, the automatic positioning process may begin with the print head 12 positioned at or near one extreme (i.e., as far away as it may be positioned or as near as it may be positioned) relative to the surface 14*a* of the photoreceptor 14. Then, the print head 12 may be stepped or progressively moved toward or away from (depending on the starting position) the surface 14*a* of the photoreceptor 14. Coincidently, the print head 12 and photoreceptor 14 are operated so as to produce a latent and/or developed image on the photoreceptor 14 including one or more marks and/or indicia that are periodically, intermittently or otherwise in an on-going fashion measured by the detector(s) 20. Suitably, the one or more marks and/or indicia take the form of one or more lines and the detector(s) 20 detect and/or measure a width of the line(s). When the measured or detected line width is at or near a minimum, the print head 12 is deemed to be properly positioned, and accordingly, further movement of the print head 12 may ceased. Of course, where the proper position has been passed (e.g., by one or more steps or some other amount) to verify that a minimum line width had in fact been reached, then the print head 12 may be reversed by an appropriate amount to that position where the line width had been detected or measured as a minimum. Suitably, to confirm that the print head 12 is properly positioned for the desired focus, the position of the print head 12 may be cycled back and forth one or more times while measuring the line width to find and/or verify that position of the print head 12 which corresponding to a minimum line width.

In another suitable embodiment, the automatic position processing may begin with the print head 12 in a first unspecified position. With the print head 12 in this first position, the print head 12 and/or photoreceptor 14 are operated so as to produce a latent and/or developed image on the photoreceptor 14 including one or more marks and/or indicia, e.g., that are detected and/or measured by the detector(s) 20. Suitably, the one or more marks and/or indicia take the form of one or more lines and the detector(s) 20 detect and/or measure a dimension of the line(s), e.g., such as their width or thickness. Then, the print head 12 is moved (e.g., by the positioning assembly PA) in a first direction relative to said photoreceptor 14 so that the print head 12 is in a second different position relative to said photoreceptor 14 than it was prior to being moved. This time, with the print head 12 in the second position, the print head 12 and/or photoreceptor 14 are again operated so as to produce a latent and/or developed image on the photoreceptor 14 including one or more marks and/or indicia that are the same or substantially similar to those produced in accordance with the previous operation when the print head 12 was at the first position. A further measurement of a dimension of the marks and/or indicia (e.g., the width or thickness of the line(s)) produced with the print head 12 in the second position is taken and/or obtained, e.g., again using the detector(s) 20. Suitably, a result of this further measurement (i.e., with the print head 12 in the second position) is compared to the previous measurement result (i.e., with the print head 12 in the first position); and in response to a result of the comparison, the print head 12 is selectively moved again, this time in a selected second direction relative to the photoreceptor 14.

More specifically, if the movement of the print head 12 from the first position to the second position resulted in a better focus (i.e., moving into focus), then the measured line width should decrease as a result of the movement, otherwise if the movement of the print head 12 from the first position to the second position resulted in poorer focus (i.e., moving out of focus), then the measured line width should increase as a result of the movement. Accordingly, the second direction of movement is selected to be substantially a same direction as the first direction when the result of the comparison is that the result of the further measurement is less than the previous result, otherwise the second direction of movement is selected to be substantially an opposite direction from the first direction when the result of the comparison is that the result of the further measurement is greater than the previous result. Suitably, the forgoing process and/or steps may be repeated and/or cycled until further movement of the print head 12 in either direction results in a poorer focus being achieved (i.e., movement of the print head 12 in either direction results in thicker lines being detected and/or measured).

In practice, run out and/or other variations in the photoreceptor 14 (e.g., variations in the photoreceptor's diameter) may affect and/or alter the resulting focus, e.g., as the photoreceptor 14 rotates. Accordingly, in one suitable embodiment, a line (e.g., which is detected and/or measured with the detector(s) 20) is produced on the photoreceptor 14 for one complete revolution (or nearly one complete revolution) of the photoreceptor 14 while the print head 12 is at a given position relative to the surface 14*a* of the photoreceptor 14. The ascribed width or thickness of the line may then be computed as an average, mean, median or other statistically significant measure of central tendency of the detected and/or measured width or thickness of the line at a plurality of different points along the length of the line. Additionally, it is to be appreciated that detected and/or measured marks and/or indicia (e.g., lines) may be employed at or near opposite ends 14*c* and 14*d* of the photoreceptor 14. Suitably, the marks and/or indicia employed at the respective ends 14*c* and 14*d* of the photoreceptor 14 are produced and detected and/or measured as disclosed herein, and based thereon, the corresponding ends 12*a* and 12*b* of the print head 12 may be automatically positioned, independently and/or otherwise, as disclosed herein.

Optionally, the autofocusing and/or automatic positioning of the print head 12 as disclosed herein may be performed periodically or intermittently, e.g., at each power up or power on of the print engine 10, each time a new photoreceptor 14 is installed, upon significant environmental condition changes, etc. Suitably, the autofocusing and/or automatic positioning the print head 12 as disclosed herein is carried out with no (or minimal) user interaction. In one suitable embodiment, the positioning assembly PA may be provisioned, in response to a suitable signal or other indication, to automatically retracted the print head 12 as far or nearly as far as possible from the surface 14*a* of the photoreceptor 14 at selected times, e.g., to thereby facilitate easy removal of the photoreceptor 14 from the print engine 10 and/or easy installation of a replacement photoreceptor 14. In one exemplary embodiment, in order to promote good vibration damping, the print engine 10 is arranged so that there is minimal and/or no direct mechanical coupling between the photoreceptor 14 and the print head 12.

As shown in the FIGURE, the positioning assembly PA employees lead screws 40 and 42 and a pair of motors 50 and 52 to selectively position respective ends 12*a* and 12*b* of the print head 12 relative to the photoreceptor 14. However, in other suitable embodiments, various other mechanical linkages and/or devices may be used to achieve similar results. For example, in one suitable alternative embodiment, an offset wheel turned by a motor may be employed at either or both ends 12*a* and 12*b* of the print head 12 to cam the respective ends 12*a* and/or 12*b* selectively toward and/or away from the surface 14*a* of the photoreceptor 14. Optionally, a single motor may be employee to selectively turn both offset wheels independently. In this case, the single motor is optionally arranged and/or mechanically coupled to the offset wheels such that when the motor rotates in a first direction only one of the offset wheels is turned, while when the motor is rotated in a second direction (opposite of the first) only the other of the offset wheels is turned. Of course, in such an arrangement, it is to be appreciated that a given end of the print head 12 may begin in an arbitrary home position and with one full 360 degree rotation of the offset wheel, that end of the print head 12 will travel through a full range of available positions and return to the home position. That is to say, the offset wheel upon a complete rotation thereof in only one direction, subjects its respective end of the print head 12 to a full range of actuation starting from a home position and returning to the same home position.

The above methods and/or apparatus have been described with respect to particular embodiments. It is to be appreciated, however, that certain modifications and/or alteration are also contemplated.

In any event, it is to be appreciated that in connection with the particular exemplary embodiment(s) presented herein certain structural and/or function features are described as being incorporated in defined elements and/or components. However, it is contemplated that these features may, to the same or similar benefit, also likewise be incorporated in other elements and/or components where appropriate. It is also to be appreciated that different aspects of the exemplary embodiments may be selectively employed as appropriate to achieve other alternate embodiments suited for desired applications, the other alternate embodiments thereby realizing the respective advantages of the aspects incorporated therein.

It is also to be appreciated that any one or more of the particular tasks, steps, processes, methods, functions, elements and/or components described herein may suitably be implemented via hardware, software, firmware or a combination thereof. In particular, the motor controller 30 may be embodied by a computer or other electronic data processing device that is configured and/or otherwise provisioned to perform one or more of the tasks, steps, processes, methods and/or functions described herein. For example, a computer or other electronic data processing device embodying the controller 30 may be provided, supplied and/or programmed with a suitable listing of code (e.g., such as source code, interpretive code, object code, directly executable code, and so forth) or other like instructions or software or firmware, such that when run and/or executed by the computer or other electronic data processing device one or more of the tasks, steps, processes, methods and/or functions described herein are completed or otherwise performed. Suitably, the listing of code or other like instructions or software or firmware is implemented as and/or recorded, stored, contained or included in and/or on a non-transitory computer and/or machine readable storage medium or media so as to be providable to and/or executable by the computer or other electronic data processing device. For example, suitable storage mediums and/or media can include but are not limited to: floppy disks, flexible disks, hard disks, magnetic tape, or any other magnetic storage medium or media, CD-ROM, DVD, optical disks, or any other optical medium or media, a RAM, a ROM, a PROM, an EPROM, a FLASH-EPROM, or other memory or chip or cartridge, or any other tangible medium or media from which a computer or machine or electronic data processing device can read and use. In essence, as used herein, non-transitory computer-readable and/or machine-readable mediums and/or media comprise all computer-readable and/or machine-readable mediums and/or media except for a transitory, propagating signal.

Optionally, any one or more of the particular tasks, steps, processes, methods, functions, elements and/or components described herein may be implemented on and/or embodiment in one or more general purpose computers, special purpose computer(s), a programmed microprocessor or microcontroller and peripheral integrated circuit elements, an ASIC or other integrated circuit, a digital signal processor, a hardwired electronic or logic circuit such as a discrete element circuit, a programmable logic device such as a PLD, PLA, FPGA, Graphical card CPU (GPU), or PAL, or the like. In general, any device, capable of implementing a finite state machine that is in turn capable of implementing the respective tasks, steps, processes, methods and/or functions described herein can be used.

Additionally, it is to be appreciated that certain elements described herein as incorporated together may under suitable circumstances be stand-alone elements or otherwise divided. Similarly, a plurality of particular functions described as being carried out by one particular element may be carried out by a plurality of distinct elements acting independently to carry out individual functions, or certain individual functions may be split-up and carried out by a plurality of distinct elements acting in concert. Alternately, some elements or components otherwise described and/or shown herein as distinct from one another may be physically or functionally combined where appropriate.

In short, the present specification has been set forth with reference to preferred embodiments. Obviously, modifications and alterations will occur to others upon reading and understanding the present specification. It is intended that the invention be construed as including all such modifications and alterations insofar as they come within the scope of the appended claims or the equivalents thereof.

What is claimed is:

1. A method for automatically positioning a print head relative to a photoreceptor in a xerographic print engine, said photoreceptor having a first end and a second end opposite the first end and said print head having a first end spaced apart from and facing the first end of the photoreceptor and a second end spaced apart from and facing the second end of the photoreceptor, said method comprising:

operating the print head to produce a latent image formed on the photoreceptor, said latent image including a first indicia formed near a first end of the photoreceptor and a second indicia formed near the second end of the photoreceptor, said second indicia being different from the first indicia;

measuring a first dimension of the first indicia and a second dimension of the second indicia; and automatically positioning said first end of the print head relative to the first end of photoreceptor in response to a result of said measuring of the first dimension and automatically positioning said second end of the print head relative to the second end of the photoreceptor in response to a result of said measuring of the second dimension.

2. The method of claim 1, wherein measuring the indicia includes:

developing a visible image corresponding to the latent image on the photoreceptor, said visible image including a mark first and second marks corresponding to said first and second indicia, respectively; and measuring dimensions of said first and second marks.

3. The method of claim 2, wherein the first and second marks are lines and measuring said marks comprises measuring a width of each line.

4. A method for automatically positioning a print head relative to a photoreceptor in a xerographic print engine, said method comprising:

operating the print head to produce an indicia in a first latent image formed on the photoreceptor;

taking a first measurement of a dimension of the indicia;

automatically positioning said print head in a first position relative to the photoreceptor in response to a result of said measuring;

moving said print head in a first direction relative to said photoreceptor so that the print head is in a second position relative to said photoreceptor, said second position being different than the first position;

operating the print head again to produce the indicia in the latent image formed on the photoreceptor with the print head in the second position;

taking a second measurement of the dimension of said indicia produced with the print head in the second position;

comparing a result of the second measurement to the result of said first measurement; and moving said print head in a selected second direction relative to said photoreceptor in response to a result of said comparing.

5. The method of claim 4, wherein said selected second direction is substantially a same direction as the first direction when the result of said comparison is that the result of the second measurement is less than the result of said first measurement.

6. The method of claim 4, wherein said selected second direction is substantially an opposite direction from the first direction when the result of said comparison is that the result of the second measurement is greater than the result of said first measurement.

7. The method of claim 1, wherein said positioning comprises independently moving the first and second ends of said print head selectively relative to said first and second ends of the photoreceptor.

8. The method of claim 1, wherein said positioning of the print head comprises selectively controlling actuation of at least one motor, said motor being operatively engaged with the print head so as to move the print head in response to actuation of the motor.

9. The method of claim 1, wherein said measuring comprises detecting each of said first and second indicia directly within the latent image on the photoreceptor with a detector.

10. A xerographic print engine comprising:

a photoreceptor having a first end and a second end opposite the first end;

a print head having a first end spaced apart from and facing the first end of the photoreceptor and a second end spaced apart from and facing the second end of the photoreceptor, said print head being arranged to selectively illuminate the photoreceptor in order to form a latent image on the photoreceptor, said latent image including a first indicia formed near the first end of the photoreceptor and a second indicia formed near the second end of the photoreceptor;

a first detector which is employed to measure a dimension of the first indicia and a second detector which is employed to measure a dimension of the second indicia; and a positioning assembly that receives feedback from said first and second detectors and in response to the measured dimensions of the first and second indicia automatically adjusts: (i) a spacing between the first end of the print head and the first end of the photoreceptor; and (ii) a spacing between the second end of the print head and the second end of the photoreceptor.

11. The xerographic print engine of claim 10, wherein said positioning assembly includes:

a motor which is selectively actuated to move the print head via a link operatively coupling the motor to said print head.

12. The xerographic print engine of claim 11, wherein said link comprises a lead screw that operatively engages with the print head and the motor, such that actuation of the motor turns the lead screw to thereby move the print head relative to the photoreceptor.

13. The xerographic print engine of claim 12, wherein the motor is a stepper motor which turns the lead screw by about 1.8 degrees per motor step, and the lead screw includes threads with a pitch of about 0.35 mm.

14. The xerographic print engine of claim 11, wherein the motor is a stepper motor positioning assembly is arranged such that for each motor step the print head is moved by an amount less than or equal to about 1.75 μm.

15. The xerographic print engine of claim 10, wherein the positioning assembly is equipped to independently adjust the spacing between the print head and photoreceptor at the first ends thereof based upon the measured dimension of the first indicia and at the second ends thereof based upon the measured dimension of the second indicia.

* * * * *